US006142748A

United States Patent [19]

Harris et al.

[11] Patent Number: 6,142,748

[45] Date of Patent: Nov. 7, 2000

[54] DEGAS PIPING FOR PUMPS

[75] Inventors: Robert T. Harris; Brent A. Tennant, both of Kingsport; William M. Lambert, Blountville, all of Tenn.

[73] Assignee: Eastman Chemical Company, Kingsport, Tenn.

[21] Appl. No.: 09/376,624

[22] Filed: Aug. 18, 1999

[51] Int. Cl.[7] ..... F04B 23/00; F04B 17/03

[52] U.S. Cl. ..... 417/313; 417/369; 417/53; 165/278; 165/104.27; 165/917

[58] Field of Search ..... 417/313, 369, 417/370, 366, 53; 165/302, 278, 104.27, 104.32, 917, 111

[56] References Cited

U.S. PATENT DOCUMENTS

| | | | |
|---|---|---|---|
| 1,619,661 | 3/1927 | Field | 417/369 |
| 4,047,561 | 9/1977 | Jaster et al. | 165/278 |
| 4,057,368 | 11/1977 | Balling | 417/313 |
| 4,115,038 | 9/1978 | Litzenberg | 417/357 |
| 4,301,358 | 11/1981 | Venot | 219/388 |
| 4,465,437 | 8/1984 | Jensen | 417/366 |
| 4,470,450 | 9/1984 | Bizzell et al. | 165/104.25 |
| 4,537,248 | 8/1985 | Minami | 165/113 |
| 4,616,980 | 10/1986 | Carpenter | 417/357 |
| 4,691,510 | 9/1987 | Taylor et al. | 60/39.094 |
| 4,760,742 | 8/1988 | Hatton | 73/861.04 |
| 4,814,044 | 3/1989 | Hitt | 196/98 |
| 5,256,038 | 10/1993 | Fairman | 417/423 |
| 5,397,220 | 3/1995 | Akihisa et al. | 417/369 |
| 5,490,387 | 2/1996 | Bisson et al. | 60/734 |
| 5,810,074 | 9/1998 | Hancock | 165/112 |

*Primary Examiner*—Charles G. Freay
*Assistant Examiner*—Robert Z. Evora
*Attorney, Agent, or Firm*—Karen A. Harding; Harry J. Gwinnell

[57] ABSTRACT

A method and apparatus for separating entrained gases from a pumped fluid. A degas pipe having an increased inner dimension relative to surrounding process piping is provided to generate a stratified two-phase gas/liquid flow. A controlled release mechanism permits selective removal of gas from the degas pipe.

29 Claims, 3 Drawing Sheets

DEGAS PIPING FOR PUMPS

BACKGROUND OF THE INVENTION

1. Field of the Invention

The present invention relates generally to the field of fluid transport, and more particularly to a method and apparatus for venting entrained gas from pumped fluids.

2. Description of Related Art

Canned motor pumps are frequently used in processes in which release of the process fluid from other types of pumps, such as sealed type pumps, presents a process, safety or environmental hazard. Because canned motor pumps are fully enclosed they are preferred over sealed pumps which rely on a mechanical seal or shaft packing to prevent the release of the process fluid. FIG. 1 shows a typical canned motor pump 10 according to known form. An electric motor 12 drives a pump impeller 14 to pump a process fluid from a suction port 16 to a discharge port 18 in a pump housing 20. The motor 12 is housed within a fluid-tight motor housing 22 and a can 23. In some applications, a portion of the pumped process fluid is bled off adjacent the discharge port 18, and circulates through a cooling fluid circuit 24. The fluid circulated through the cooling fluid circuit 24 is directed through the bearings 26 and around the rotor 27 to cool and lubricate the motor 12 and bearings 26. An auxiliary impeller can be provided, typically within the motor section, to circulate the cooling fluid through the cooling fluid circuit. U.S. Pat. No. 4,616,980 to Carpenter and U.S. Pat. No. 5,397,220 to Akihisa et al. are incorporated herein by reference for general background information regarding canned motor pumps. In other applications, a segregated cooling fluid circuit is provided. Rather than bleeding off a portion of the process fluid, a separate non-process coolant fluid is circulated through a segregated cooling fluid circuit to cool and lubricate the motor and associated bearings. U.S. Pat. No. 5,256,038 to Fairman is incorporated herein by reference for additional background information. Canned motor pumps are commercially available from several manufacturers including Heyward Tyler, Sundyne and Hermetic.

Heretofore, canned motor pumps, and to some extent sealed pumps as well, have suffered certain disadvantages. For example, during use, the pumps circulate process fluids along fluid paths that, in many instances, contain expansion tanks that are commonly blanketed with inert gases. Inert gases suitable for blanketing processing fluids include any gas which is nonreactive with the cooling and/or process fluids in use. Suitable inert gases include nitrogen, argon, and the like. As the process fluids cool in the tank, inert gas is absorbed into the process fluid. Inert gases may also be introduced during shutdown and startup of a process, as various valves are opened or closed and the like. Upon heating of the gas, absorbed inert gas forms entrained bubbles, which frequently accumulate in a pump, particularly at the pump shaft because of the centrifugal forces. Accumulation of gases at the shaft can cause mechanical failures in sealed type pumps and permits gas to migrate into the cooling circuit in canned motor pumps. Gas entrainment and accumulation in canned motor pumps can cause cavitation of the auxiliary cooling impeller, causing loss of cooling fluid to the motor which can result in motor failure.

Prior attempts to address this problem have included forcing process fluid from the discharge of the impeller into the canned motor and back through the eye of the impeller. While this may slow the collection of entrained gas around the auxiliary cooling impeller, the problem is not entirely solved. Accumulation of gas, even at a relatively slow rate is generally not acceptable because the pump, and therefore the process, must be stopped periodically to vent accumulated entrained gas, thereby reducing process efficiency.

SUMMARY OF THE INVENTION

In accordance with the purposes of this invention, as embodied and broadly described herein, this invention, in one aspect, relates to an apparatus for removal of entrained gas from a fluid, said apparatus comprising a degassing enclosure for separating entrained gas from a liquid; and a controlled release mechanism for selective removal of gas from said degassing enclosure, said controlled release mechanism comprising pressure regulating means for maintaining a pressure differential between an internal pressure within said degassing enclosure and an external pressure exterior of said degassing enclosure.

In another aspect, the invention comprises a pump system comprising a pump having a motor and an impeller; a fluid conduit receiving a fluid flow from said pump; and a degassing enclosure coupled to said fluid conduit.

In another aspect, the invention comprises a cooling fluid circuit for delivering cooling fluid to a canned motor pump, said cooling fluid circuit comprising a fluid conduit having a first inner diameter, a degas pipe coupled to said fluid conduit and having a second inner diameter greater than the first inner diameter, and a vent for controlled release of gas from said degas pipe.

In another aspect, the invention comprises a method for removal of gas from a fluid containment, said method comprising pumping the fluid to pressure; transmitting the fluid through a fluid conduit; separating entrained gas from the fluid in a degassing enclosure coupled to the fluid conduit; and venting separated gas from the degassing enclosure via a controlled release mechanism.

Additional advantages of the invention will be set forth in part in the detailed description including the drawing figures, which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory of preferred embodiments of the invention, and are not restrictive of the invention, as claimed.

BRIEF DESCRIPTION OF THE DRAWING FIGURES

DETAILED DESCRIPTION OF PREFERRED EMBODIMENTS

The present invention may be understood more readily by reference to the following detailed description of preferred embodiments of the invention, including the appended drawing figures referred to herein, and the examples provided therein. It is to be understood that this invention is not limited to the specific systems, devices and/or processes and conditions described, as specific systems, devices, processes and/or process conditions for fluid transport and processing as such may, of course, vary. It is also to be understood that the terminology used herein is for the purpose of describing particular embodiments only and is not intended to be limiting.

It must also be noted that, as used in the specification and the appended claims, the singular forms "a," "an" and "the" include plural referents unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Without being bound by the theories of operation set forth herein, it has been discovered that entrained gases can be vented from a pumped liquid by controlled reduction of the flow velocity of the fluid in a degassing enclosure coupled with controlled venting of collected gas from the degassing enclosure. More preferably, it has been found that gases entrained in a pumped fluid stream can be separated from the pumped liquid by incorporating a length of degas piping in the flow path of the fluid stream, as described in detail herein, and releasing the separated gases through a flow-controlled vent or standpipe.

Figure 1:
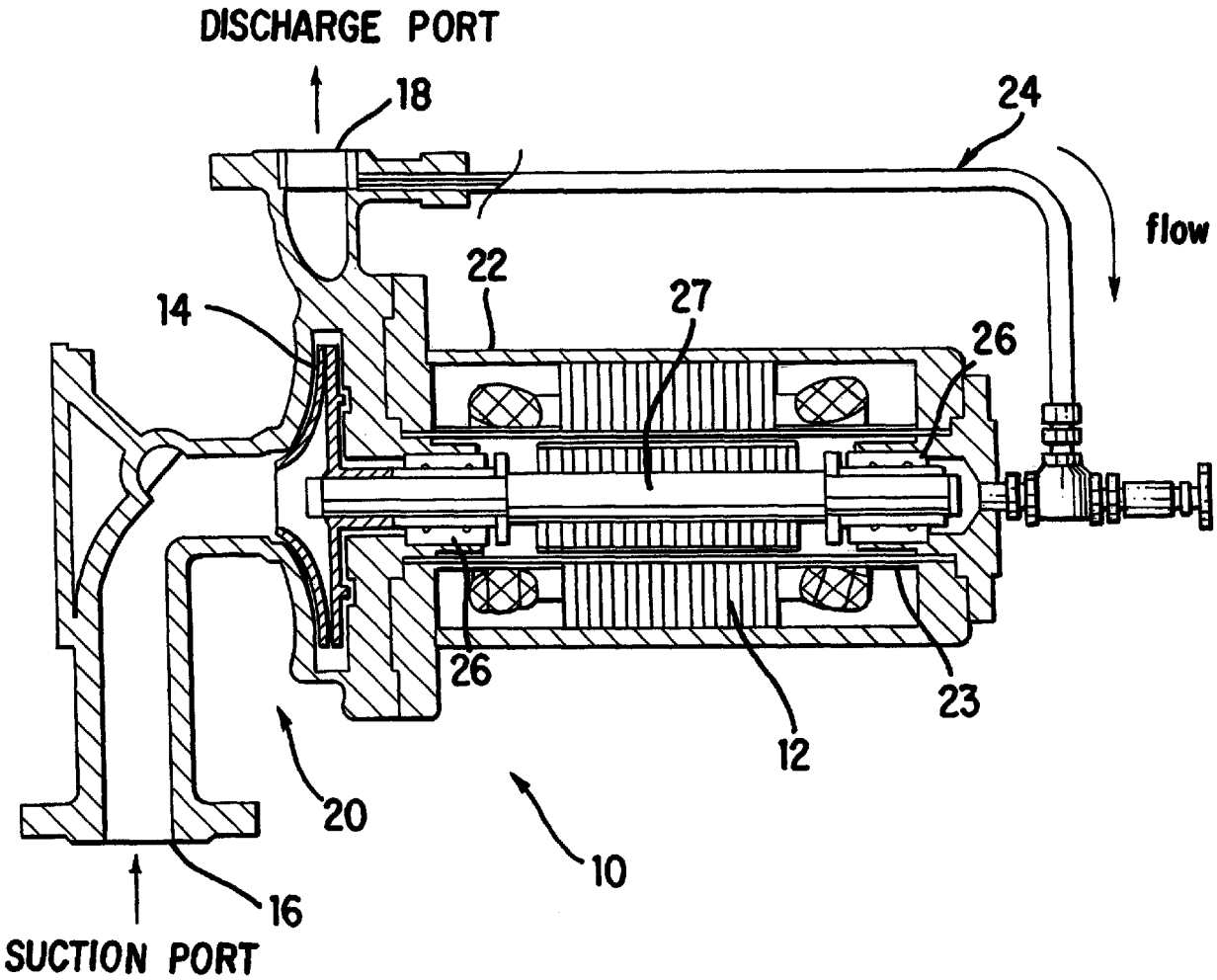
FIG. 1 PRIOR ART
FIG. 1 shows a prior art canned motor pump.
Figure 2:
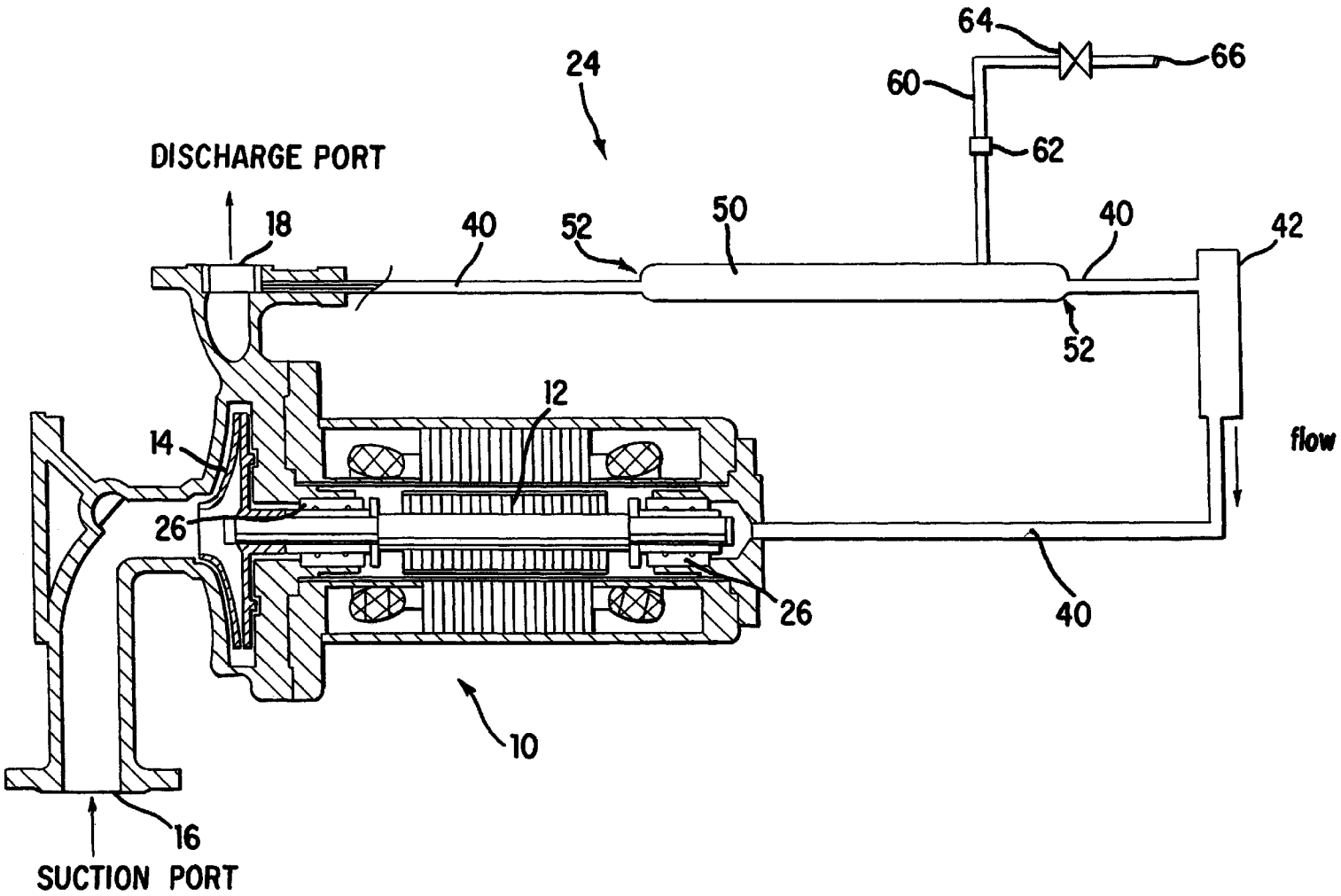
FIG. 2 shows a system and apparatus according to a preferred embodiment of the present invention.

Referring now to the drawing figures, wherein like reference numerals represent like parts throughout, example and preferred forms of the present invention will now be described. FIG. 1 shows a canned motor pump substantially according to known form which has been described above. FIG. 2 shows a canned motor pump 10 substantially similar to that shown in FIG. 1 and described above, having a cooling fluid circuit 24 improved according to a preferred form of the present invention. The impeller 14 is driven by motor 12 to pump a fluid from the suction port 16 to the discharge port 18. A portion of the fluid can be diverted from a point adjacent the discharge port 18 into the cooling fluid circuit 24. Alternatively, a segregated cooling fluid circuit can be provided. Cooling fluid is routed through the cooling fluid circuit 24 by means of one or more cooling fluid conduits 40, such as pipe or tubing of standard variety as appropriate for the fluid circulated, and is directed through the motor housing 22 to cool and/or lubricate the motor 12, the bearings 26, and/or other associated equipment.

One or more pieces of processing equipment 42 can be provided at various locations within the cooling fluid circuit 24, such as for example, a heat exchanger, a filter, a reactor, a fluid reservoir or tank, and/or auxiliary pumping devices. Process equipment and piping should be fabricated from materials which are of a composition and construction capable of withstanding the environment in which it will be used and non-reactive with potentially contacting cooling and/or process fluids. Suitable materials include stainless steel, carbon steel and other suitably rated temperature/pressure materials which are known in the art. Process and cooling fluids can be the same or different fluids, but frequently for ease of operation the process fluid and cooling fluid are the same. Suitable cooling fluids include, but are not limited to Dowtherm A®, available from Dow Chemical Co.; and Therminol VP-1®, available from Solutia Corp. The present invention is particularly useful where the process or cooling fluid presents a health, safety or environmental hazard, either because of its temperature or composition. Process fluids which fall into this category are abundant and well known in the art.

As a liquid circulates through a fluid conduit, gas commonly becomes entrained in the fluid, potentially having disadvantageous results. For example, in the pumping system depicted in FIG. 1, as the pump 10 circulates fluid through the cooling fluid circuit 24, gas may be entrained in the fluid and migrate into the motor housing 22. As used herein, the term "entrained," and like terms, refers to undissolved gas present in a fluid; for example, gas in a fluid in the form of bubbles, microbubbles, foam, froth or the like.

The present invention enables removal of entrained gas from a fluid through the provision of a degassing enclosure, such as degas pipe 50. The degas pipe 50 functions to slow the velocity of the cooling fluid in the cooling fluid circuit 24 to an extent sufficient to permit entrained gas to separate from the liquid coolant. The degas pipe 50 preferably produces a laminar, stratified, non-circular, two-phase gas/liquid flow. The reduction in velocity necessary to provide the desired two-phase (gas/liquid) flow can be determined by one of skill in the art using the size of the gas bubbles likely present and the viscosity of the fluid (see, e.g., Baker, OIL AND GAS JOURNAL 53 (12), 185–190, 192, 195 (1954)). For separation of inert gas in Dowtherm A® in a cooling fluid circuit of a canned motor pump, for example, a preferred velocity in the degas pipe is less than about 1 ft/sec., more preferably less than about 0.5 ft/sec., and most preferably less than about 0.1 ft/sec. The extent of velocity reduction in the degas pipe 50 is controlled by appropriate selection of the internal dimensions of the degas pipe 50, as may be readily determined by one of ordinary skill in the art based on the anticipated flowrate through the cooling fluid circuit. The internal dimensions of the degas pipe 50 are selected to provide a larger cross-sectional area open to fluid transport than the cross-sectional area of the fluid conduit 40 adjacent the degas pipe. For example, in particular applications, a 2:1 ratio, and more preferably a 4:1 ratio, of diameter of degas pipe 50 to diameter of pipe 40 in the remainder of the cooling circuit has been found to result in sufficient reduction of flow velocity to produce an acceptable two-phase flow. Depending on the particular characteristics of a given fluid flow, diameter ratios greater than 4:1 or less than 2:1 can produce acceptable results. The residence time of the coolant within the degas pipe 50 is controlled by appropriate selection of the length of the degas pipe 50 to allow sufficient time at the reduced velocity within the degas pipe for adequate separation of entrained gas from the liquid. The appropriate residence time for a particular fluid flow may be determined by one of ordinary skill in the art by routine experimentation, provided with the disclosure of the invention set forth herein. For example, in Dowtherm A® applications, a residence time of 45 seconds has been found sufficient to provide acceptable separation of entrained gas from the liquid. The length of degas pipe 50 necessary to provide a desired residence time can be calculated based on the flow velocity and the desired residence time. The following table provides example maximum flow rates and minimum degas pipe lengths that have been found to provide acceptable separation of entrained gas from Dowtherm A® in degas pipes of various inner diameters:

| degas pipe inner diameter (inches) | 2 | 3 | 4 | 5 | 6 | 8 | 10 |
|---|---|---|---|---|---|---|---|
| Maximum Flow Rate (gallons per minute) | 1.0 | 2.2 | 3.9 | 6.1 | 8.8 | 15.7 | 24.5 |
| Minimum Degas Pipe Length (feet) | 4.5 | 4.5 | 4.5 | 4.5 | 4.5 | 4.5 | 4.5 |

Substantially the entire length of degas pipe 50 is preferably maintained in a generally horizontal and level position. In order to provide a desired length of degas pipe 50 within a limited space, the degas pipe 50 may be formed to include one or more curved or bent sections, forming a serpentine flowpath generally along a horizontal plane. The degas pipe 50 is preferably fabricated from a length of pipe having a generally circular cross-section. Alternatively, a degas pipe or other degassing enclosure having a rectangular or other cross-sectional geometry can be provided.

The degas pipe 50 or other enclosure is preferably formed from material non-reactive with potential cooling and/or process materials, and capable of withstanding intended operating pressures and temperatures. Most preferably, the degas pipe 50 and adjacent fluid conduit(s) 40 are fabricated of the same materials of construction. The degas pipe 50 is preferably coupled to at least one adjacent fluid conduit, preferably by welding, soldering, brazing, compression fitting, threaded coupling, or other attachment means. For example, as depicted in FIG. 2, the degas pipe 50 is coupled at each end to an adjacent segment of fluid conduit 40 forming portions of the cooling fluid circuit 24 of a canned motor pump system. Preferably, eccentric couplings 52 are provided at the inlet and outlet of the degas pipe 50, coupling the degas pipe 50 and the surrounding cooling fluid circuit piping 40 in an offset orientation, whereby the longitudinal axis of the degas pipe 50 lies vertically above the longitudinal axis of the surrounding cooling fluid circuit piping 40. Although concentric couplings can provide acceptable results, eccentric couplings 52 have been found advantageous, providing less flow disturbance and promoting a more stratified two-phase flow, and presenting a more tortuous flow path to gas that might otherwise tend to remain entrained in the liquid.

The separated gas removed from the fluid is preferably vented from the degas pipe 50 or other degassing enclosure via a controlled release mechanism, such as for example a vent opening, or a stand pipe 60 extending generally upward from the degas pipe 50. In preferred form, the stand pipe 60 is attached at or near the downstream end of degas pipe 50, preferably by welding, soldering, brazing, compression fitting, threaded coupling, or other attachment means. The stand pipe 60 is preferably formed from material non-reactive with potential cooling and/or process materials and capable of withstanding intended operating pressures and temperatures, and most preferably of the same material of construction as the degas pipe 50. A sight glass 62 or other monitoring means can optionally be provided in the stand pipe 60 for visual observation or otherwise monitoring of conditions inside the stand pipe 60. The controlled release mechanism preferably comprises a flow control device 64, such as a valve, flow restrictor or orifice, to control the flow of gas therethrough, thereby maintaining a pressure differential between an internal pressure within the degassing enclosure and an external pressure exterior of the degassing enclosure, and preventing dissolved gas from coming out of solution in the degas pipe 50 or other degas enclosure. In a preferred and example embodiment, the flow control device 64 comprises an orifice valve having a small $C_V$, thereby preventing significant lowering of the pressure in the cooling fluid circuit while venting separated gas therefrom. Small $C_V$ orifice valves are commercially available from sources including, for example, Whitey Co. and Swagelok Co, of Highland, Ohio. The flow control device 64 is preferably manually operated as necessary based on visual observation via the sight glass 62 or other monitoring means. The standpipe 60 preferably further comprises one or more openings 66 for venting the separated gas to the ambient. Alternatively, separated gas can be collected from the standpipe 60 for additional processing and/or recycling.

The liquid phase stripped of entrained gas can optionally be circulated through processing equipment 42 provided in the cooling loop, such as for example a cooling means, expansion tank, reactor, mix tank, etc. Suitable cooling means include non-contact type coolers, which are well known in the art and include, but are not limited to heat exchangers, U-tube coolers, fin type coolers, shell and tube coolers and the like.

It will be understood that the embodiment of canned motor pump 10 depicted in FIG. 2 is for purposes of example only, and that the present invention is equally applicable to other types of canned motor pumps, including those having segregated cooling loops and those having process fluid-fed cooling loops, and to fluid transport systems in general, apart from applications involving canned motor pumps. For example, as shown according to a preferred form in FIG. 3, another embodiment of the present invention relates to degassing a fluid pumped through a fluid conduit 100 by a pump system comprising a sealed pump 102. With the exception of specific differences shown and described herein, the degas piping and associated equipment of this embodiment operate in a manner substantially similar to the degas piping and associated equipment described above with regard to the canned motor pump embodiment. The fluid may, for example, comprise a process fluid circulated through or around process equipment 104, 106 such as, for example, reactors, heat exchangers, mix tanks and the like. The conduit 100 preferably comprises piping or tubing fabricated of material compatible with potentially contacting fluids, and with expected temperatures and pressures. The conduit 100 can optionally take the form of a closed circuit, as depicted, or alternatively can be a one-way conduit delivering fluid to one or more locations remote from the pump 102. In this embodiment the degas piping serves to reduce or prevent gas from collecting around the pump impeller, which can cause the pump seal to dry out and fail.

Figure 3:
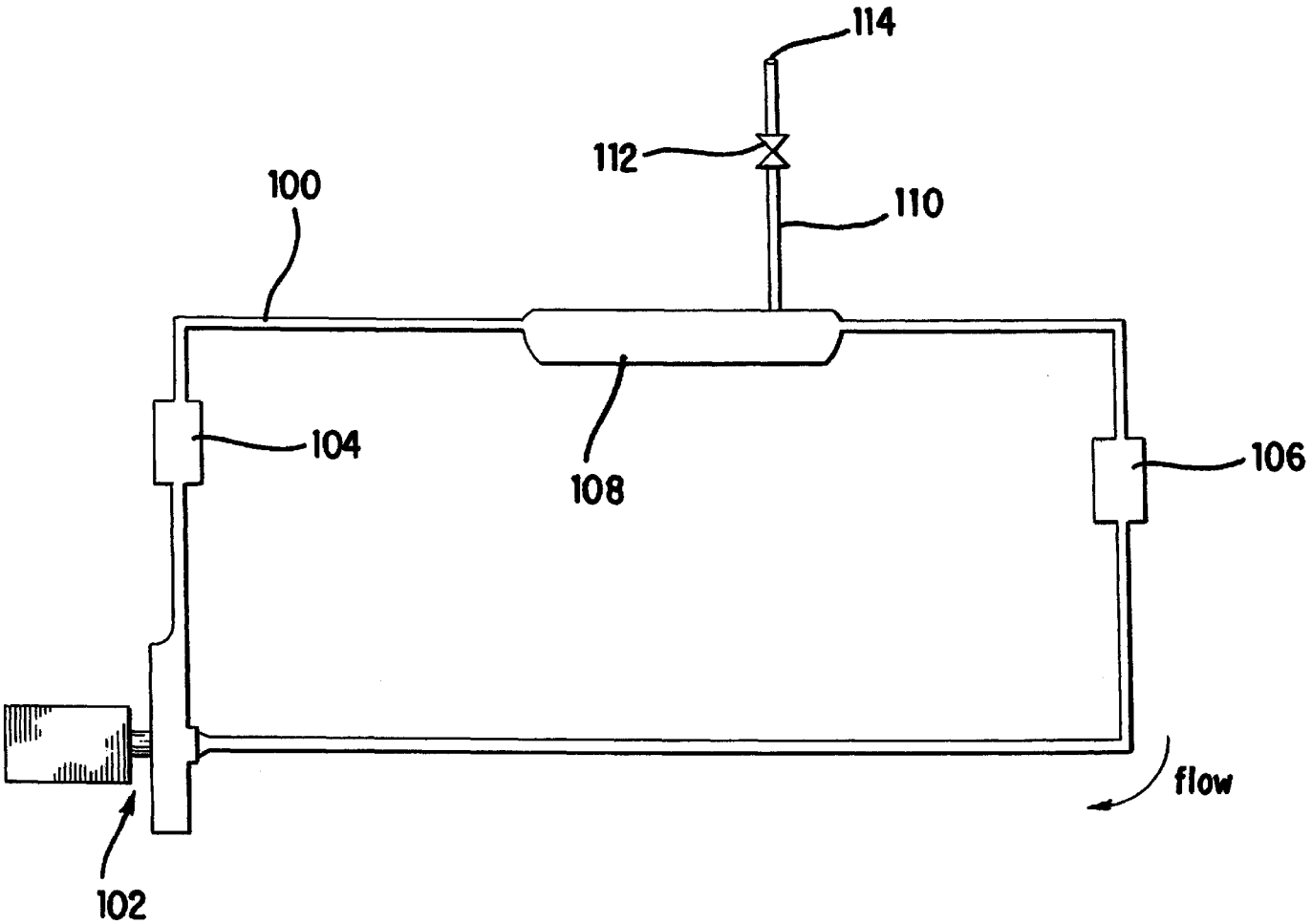
FIG. 3 shows a system and apparatus according to another preferred embodiment of the present invention.

As depicted in FIG. 3, a degassing enclosure such as a degas pipe 108 is preferably coupled to the fluid conduit 100 to separate entrained gas from the fluid. The degas piping 108 can be located either between the pump 102 and a subsequent piece of process equipment 104 or between two pieces of process equipment 104, 106. Preferably, the degas piping 108 is located where the highest concentration of entrained gas is present in the fluid. Preferably, the degas pipe 108 is constructed and installed substantially as described above, and the sizing, geometry and orientation of the degas pipe 108 are substantially as described above with regard to the example embodiment depicted in FIG. 2. The degas pipe 108 or other enclosure is preferably formed from material non-reactive with potentially contacting fluids, and capable of withstanding intended operating pressures and temperatures. Most preferably, the degas pipe 108 and the surrounding fluid conduit 100 are fabricated of the same materials of construction. The degas pipe 108 is preferably coupled to the surrounding fluid conduit 100 by welding, soldering, brazing, compression fitting, threaded coupling, or other attachment means. Preferably, eccentric couplings are provided at the inlet and outlet of the degas pipe 108, coupling the degas pipe 108 and adjacent fluid conduit(s) 100 in an offset orientation, whereby the longitudinal axis of the degas pipe 108 lies vertically above the longitudinal axis of the surrounding fluid conduit 100.

The separated gas removed from the fluid is preferably vented from the degas pipe 108 via a controlled release mechanism, such as for example a vent opening (unshown), or a stand pipe 110 extending generally upward from the degas pipe 108. As depicted in FIG. 3, the stand pipe 110 is attached at or near the downstream end of degas pipe 108, by welding, soldering, brazing, compression fitting, threaded coupling, or other attachment means. The stand pipe 110 is preferably formed from material non-reactive with potential cooling and/or process materials and capable of withstanding intended operating pressures and temperatures, and most preferably of the same material of construction as the degas pipe 108. Monitoring means such as a sight glass (unshown) can optionally be provided in the stand pipe 110 for visual observation or otherwise monitoring of conditions inside the stand pipe 110. The controlled release mechanism preferably comprises a flow control device 112, such as a valve, flow restrictor or orifice, to control the flow therethrough, thereby maintaining an elevated fluid pressure within the degassing enclosure relative to the exterior ambient pressure, and preventing dissolved gas from coming out of solution in the degas pipe 108 or other degas enclosure. In a preferred and example embodiment, the flow control device 112 comprises a small $C_V$ orifice valve. The standpipe 110 preferably further comprises one or more openings 114 for venting separated gas to the ambient. Alternatively, separated gas can be collected from the standpipe 110 for additional processing and/or recycling.

METHOD OF OPERATION

The present invention provides a method of removing entrained gas from a fluid. The method generally comprises pumping the fluid to pressure, transmitting the fluid through a fluid conduit, separating entrained gas from the fluid in a degassing enclosure coupled to the fluid conduit, and venting separated gas from the degassing enclosure via a controlled release mechanism. In example embodiments, the step of pumping the fluid to pressure comprises pumping the fluid in a canned motor pump, or alternatively, pumping the fluid using a sealed pump. In example embodiments, the step of transmitting the fluid through a fluid conduit can comprise circulating the fluid through a cooling fluid circuit of a canned motor pump, or transmitting process fluid to process equipment remote from a pump. In example embodiments, the step of separating entrained gas from the fluid in a degassing enclosure comprises reducing the flow velocity of the fluid in a degas pipe substantially as described above. In example embodiments, the step of venting separated gas from the degassing enclosure via a controlled release mechanism comprises removing gas from a degas pipe through a valve, flow restrictor or orifice.

The disclosures of any publications referred to herein are hereby incorporated by reference in their entireties into this application in order to more fully describe the state of the art to which this invention pertains.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for removal of entrained gas from a fluid, said apparatus comprising:

(a) a degassing enclosure for separating entrained gas from a liquid, the degassing enclosure comprises a degas pipe eccentrically coupled to a fluid conduit, whereby a longitudinal axis of said degas pipe is offset vertically above a longitudinal axis of the fluid conduit; and (b) a controlled release mechanism for selective removal of gas from said degassing enclosure to ambient, said controlled release mechanism comprising a flow control device for maintaining a pressure differential between an internal pressure within said degassing enclosure and an external pressure exterior of said degassing enclosure.

2. The apparatus of claim 1, wherein said degas pipe has an inner diameter of at least about two times an inner diameter of the fluid conduit.

3. The apparatus of claim 1, wherein said degas pipe has a length of at least 4.5 feet.

4. The apparatus of claim 1, wherein said degas pipe has a generally circular cross section.

5. The apparatus of claim 1, wherein said controlled release mechanism comprises a standpipe extending generally upward from a downstream portion of said degassing enclosure.

6. The apparatus of claim 5, wherein said flow control device comprises a valve.

7. The apparatus of claim 6, wherein said valve comprises a small $C_v$ orifice valve.

8. A pump system comprising:

(a) a pump comprising a motor and an impeller;

(b) a fluid conduit receiving a pumped fluid from said pump; and, (c) a degassing enclosure coupled to said fluid conduit for separating entrained gases from a liquid, wherein the separated gases are released to ambient, the degassing enclosure comprises a degas pipe eccentrically coupled to a fluid conduit, whereby a longitudinal axis of said degas pipe is offset vertically above a longitudinal axis of the fluid conduit.

9. The pump system of claim 8, wherein said pump comprises a canned motor pump.

10. The pump system of claim 9, wherein said fluid conduit comprises a cooling fluid circuit for delivering cooling fluid to cool said canned motor pump.

11. The pump system of claim 10, wherein said cooling fluid circuit comprises piping having an inner diameter, and wherein said a degas pipe has an inner diameter at least two times the inner diameter of the piping of said cooling fluid circuit.

12. The pump system of claim 11, wherein said degas pipe has a length of at least 4.5 feet.

13. The pump system of claim 8, further comprising a controlled release mechanism for selective removal of the separated gases from said degassing enclosure, said controlled release mechanism comprising a flow control device for maintaining a pressure differential between an internal pressure within said degassing enclosure and an external pressure exterior of said degassing enclosure.

14. The pump system of claim 13, wherein said controlled release mechanism comprises a standpipe extending generally upward from a downstream portion of said degassing enclosure.

15. The pump system of claim 14, wherein said flow control device comprises a valve.

16. The pump system of claim 15, wherein said valve comprises a small $C_v$ orifice valve.

17. A cooling fluid circuit for delivering cooling fluid to a canned motor pump, said cooling fluid circuit comprising:

a fluid conduit having a first inner diameter, a degas enclosure having a degas pipe eccentrically coupled to said fluid conduit and having a second inner diameter larger than the first inner diameter, a longitudinal axis of said degas pipe is offset vertically above a longitudinal axis of the fluid conduit and, means for controlled release of gas from said degas pipe to ambient.

18. A method for removal of entrained gas from a fluid, said method comprising:

(a) pumping the fluid to pressure;

(b) transmitting the fluid through a fluid conduit;

(c) separating entrained gas form the fluid in a degassing enclosure coupled to the fluid conduit, the degassing enclosure comprises a degas pipe eccentrically coupled to a fluid conduit, whereby a longitudinal axis of said degas pipe is offset vertically above a longitudinal axis of the fluid conduit; and, (d) venting separated gas from the degassing enclosure to ambient.

19. The method of claim 18, wherein the step of pumping the fluid comprises pumping the fluid in a canned motor pump.

20. The method of claim 19, wherein the step of transmitting the fluid through a fluid conduit comprises circulating the fluid through a cooling fluid circuit delivering cooling fluid to the canned motor pump.

21. The method of claim 18, wherein the step of separating entrained gas from the fluid in the degassing enclosure comprises reducing the flow velocity of the fluid in the degas pipe.

22. The method of claim 21, wherein the step of reducing the flow velocity of the fluid comprises reducing the flow velocity sufficient of generate a stratified two-phase gas/liquid flow.

23. The method of claim 21, wherein the step of reducing the flow velocity of the fluid comprises reducing the flow velocity of less than about 1 ft./sec.

24. The method of claim 21, wherein the step of reducing the flow velocity of the fluid comprises reducing the flow velocity to less than about 0.5 ft./sec.

25. Thee method of claim 21, wherein the step of reducing the flow velocity of the fluid comprises reducing the flow velocity to less than about 0.1 ft./sec.

26. The method of claim 21, wherein the step of venting separated gas from the degassing enclosure via a controlled release mechanism comprises removing gas from the degas pipe through a stand pipe comprising a flow control device.

27. The method of claim 18, wherein the step of pumping the fluid comprises pumping the fluid in a motor pump, in which the fluid is a cooling fluid that is separate from a process fluid that is concurrently pumped by the motor pump.

28. A pump system comprising:

(a) a pump comprising a motor and an impeller, which pumps a process fluid and a cooling fluid, in which the process and cooling fluids are separated from each other;

(b) a fluid conduit receiving the pumped cooling fluid from said pump; and, (c) a degassing enclosure coupled to said fluid conduit for degassing the cooling fluid to ambient, the degassing enclosure comprises a degas pipe eccentrically coupled to a fluid conduit, whereby a longitudinal axis of said degas pipe is offset vertically above as longitudinal axis of the fluid conduit.

29. The pumping system of claim 28, wherein the cooling fluid and the process fluid are different types of fluid.

* * * * *